US007353854B2

(12) United States Patent
Yu Chen

(10) Patent No.: US 7,353,854 B2
(45) Date of Patent: Apr. 8, 2008

(54) ADHESIVE TAPE ROLL FIXING DEVICE FOR AN ADHESIVE TAPE DISPENSER

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 402 days.

(21) Appl. No.: 11/088,814

(22) Filed: Mar. 25, 2005

(65) Prior Publication Data

US 2006/0213622 A1 Sep. 28, 2006

(51) Int. Cl.
*B32B 38/04* (2006.01)
*B65H 35/07* (2006.01)

(52) U.S. Cl. ..... 156/527; 156/574; 156/577

(58) Field of Classification Search ..... 156/574, 156/577, 526, 527
See application file for complete search history.

(56) References Cited

U.S. PATENT DOCUMENTS 3,753,839 A * 8/1973 Funke et al. ..... 156/577
4,623,421 A * 11/1986 Cardin ..... 156/523
5,641,378 A * 6/1997 Luhman et al. ..... 156/577
7,040,370 B2 * 5/2006 Miller ..... 156/577
2002/0124969 A1 * 9/2002 Hsu ..... 156/577

* cited by examiner

*Primary Examiner*—Mark A Osele
(74) *Attorney, Agent, or Firm*—Ming Chow Sinorica, LLC

(57) ABSTRACT

An adhesive tape roller fixing device for an adhesive tape dispenser includes a pivotal shaft fixed sidewise on a sidewall of the dispenser body, and a small roller, a guide roller and a blade orderly fixed at the front portion of the sidewall. The pivotal shaft has a cylindrical body, two lengthwise slots formed spaced apart in the cylindrical body to define two elastic section walls, and a one-way constrict wall extending out from the outer surface of the cylindrical body on an irregular section wall of the cylindrical body. Then when an adhesive tape roll is fitted around on the pivotal shaft, two hooks of the two elastic section walls stop the outer end of the adhesive tape roll and keep it from falling off. Further, the one-way constrict wall elastically pushes outward tightly the adhesive tape roll to let it rotate only forward, never backward.

4 Claims, 5 Drawing Sheets

ADHESIVE TAPE ROLL FIXING DEVICE FOR AN ADHESIVE TAPE DISPENSER

BACKGROUND OF THE INVENTION

1. Field of the Invention

This invention relates to an adhesive tape dispenser, particularly to one provided with an adhesive-tape-roll fixing device able to prevent effectively the adhesive tape roll from rotating backward.

2. Description of the Prior Art

Conventional adhesive tape dispensers do not have any structure for preventing an adhesive tape from rotating backward, and the outer tip of the tape has to be pulled out for a certain length in case of adhering the tape and to have the tape being able to be adhered subsequently next time. So the adhesive tape roll in the tape dispenser is apt to rotate back even during the time when using it or putting it away, and the tape tip has to be newly pulled out and positioned properly for next adhering action. This is a big harassment in using the conventional adhesive tape dispenser.

SUMMARY OF THE INVENTION

An adhesive tape roller fixing device for an adhesive tape dispenser according to the invention includes a pivotal shaft fixed to extend sidewise on a sidewall of the dispenser body, a small roller, a guide roller and a blade orderly provided sidewise on a front portion of the sidewall. The pivotal shaft has two lengthwise slots formed spaced apart in the cylindrical body of the pivotal shaft to define two elastic section walls. Further, a one-way constrict wall is provided to extend from the outer surface of the cylindrical body and closely along on the irregular wall section of the cylindrical body to shrink elastically inward. So after the adhesive tape roller is fitted around on the pivotal shaft, the adhesive tape is pulled to extend through the gap between the small roller and the guide roller to reach the blade for being cut. Further, the adhesive tap roller is kept from falling off by means of hooks formed at the free end of the cylindrical body, and rotates only forward by means of the one-way constrict wall elastically pushing outward the paper tube of the adhesive tape roller.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
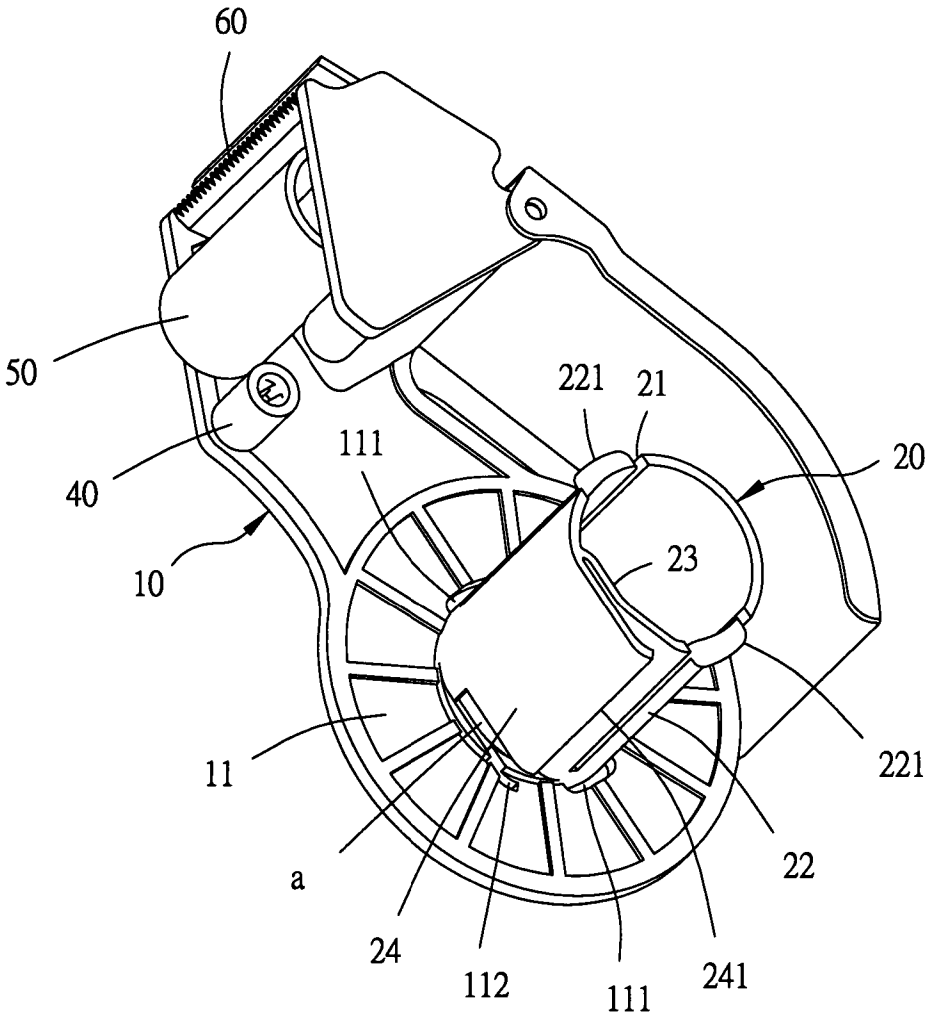
FIG. 1 is a perspective view of an adhesive tape dispenser provided with an adhesive-tape-roll fixing device in the present invention.

A preferred embodiment of an adhesive tape roll fixing device for an adhesive tape dispenser in the present invention, as shown in FIG. 1, is applied to a simple-typed tape dispenser, which includes a dispenser body 10 and a sidewall

11 of the dispenser body 10, and includes a pivotal shaft 20 provided to extend sidewise from a rear portion of the sidewall 11 for pivotally fitting the paper tube 31 of an adhesive tape roll 30 around the pivotal shaft 20, a small roller 40 provided laterally at a front portion of the sidewall, a guide roller 50 in front of the small roller 40 with a gap, and a blade 60 at the front end of the sidewall 11. Thus, an adhesive tape 32 of the adhesive tape roll 30 can be pulled to extend through a gap between the small roller 40 and the guide roller 50 and around a part of the guide roller 50 to reach the blade 60 to be cut off after adhering the adhesive tape 32 on something.

Figure 2:
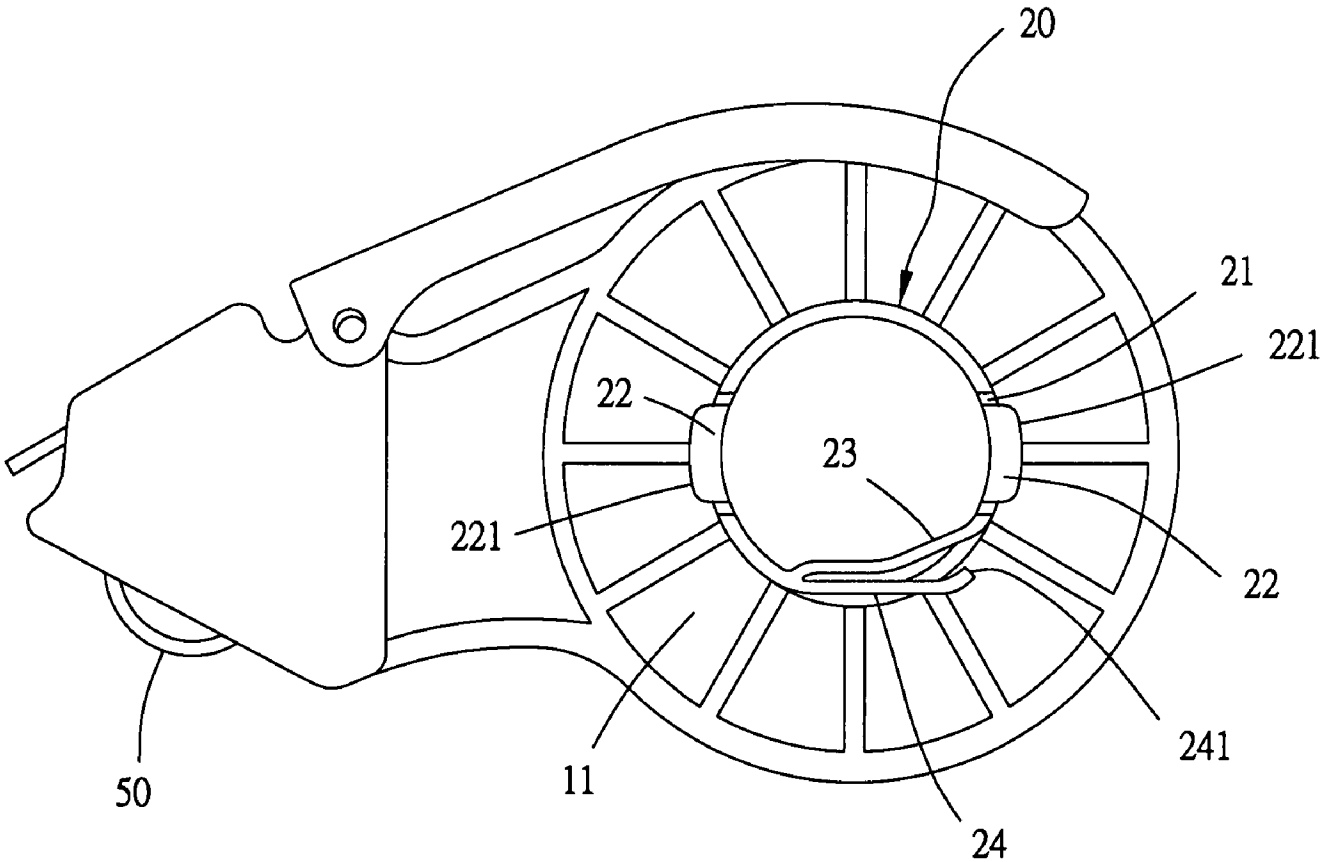
FIG. 2 is a front view of the adhesive tape dispenser in the present invention.
Figure 3:
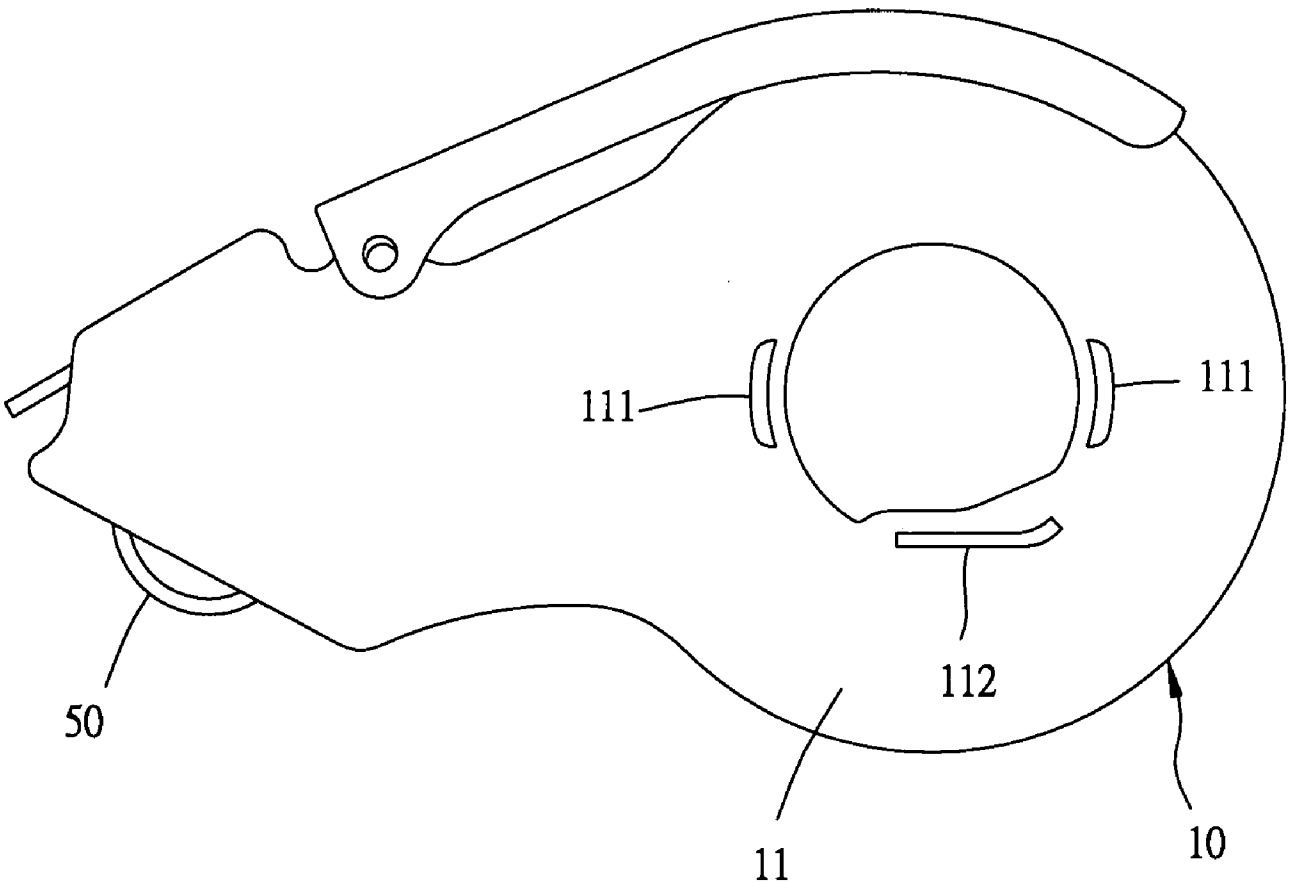
FIG. 3 is a rear view of the adhesive tape dispenser in the present intention.
Figure 4:
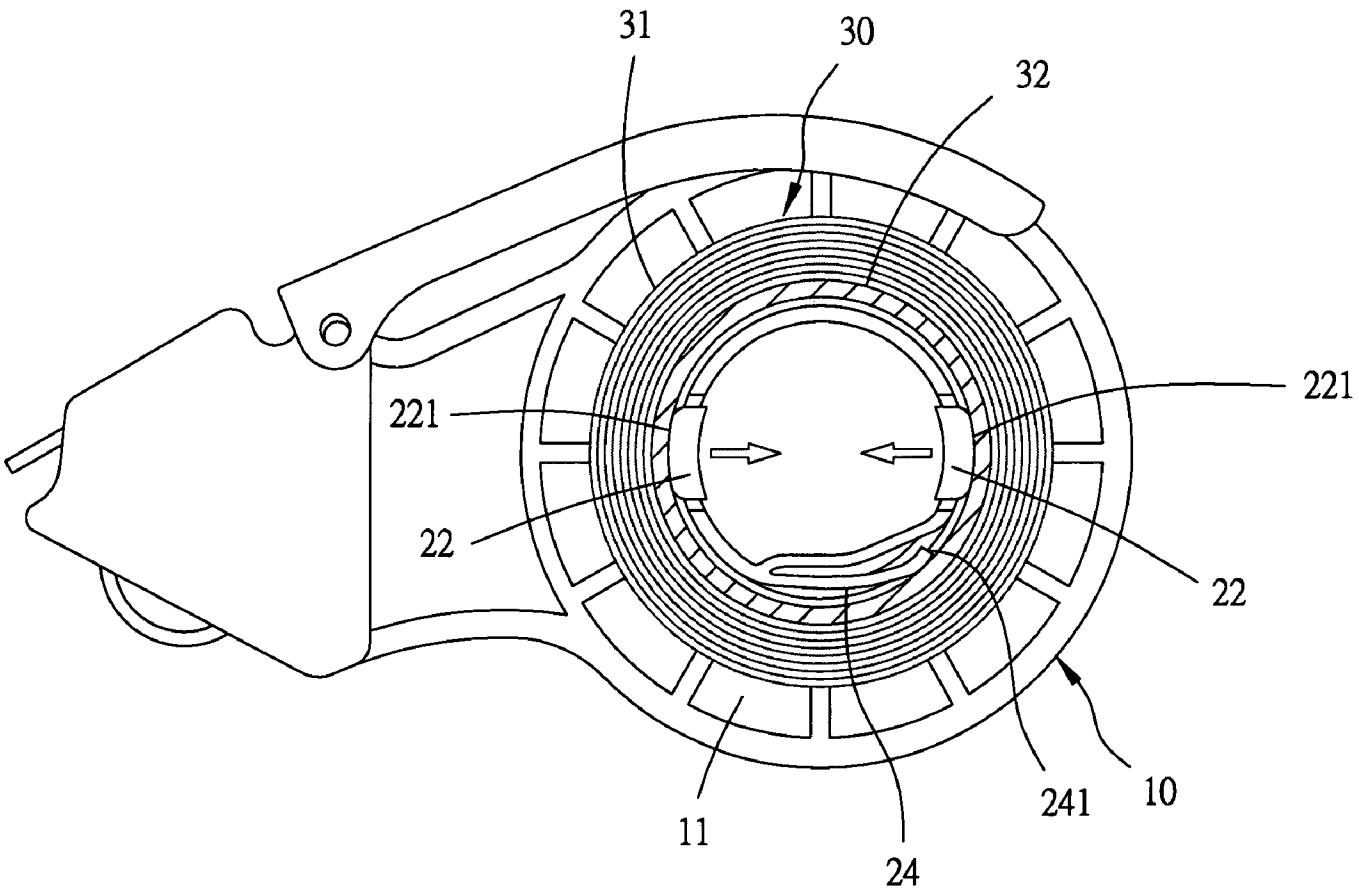
FIG. 4 is a side view of a adhesive tap roll being pivotally fixed on a tape roller in the present invention; and, FIG. 5 is a side view of the adhesive tape roll pivotally fixed on the tape roller in the present invention.

The pivotal shaft 20 as shown in FIGS. 2 and 3, has a cylindrical body, extending laterally from the sidewall 11 of the dispenser body 10, having two lengthwise slots 21 formed lengthwise and spaced apart to define two symmetrical elastic section walls 22 in the cylindrical body of the pivotal shaft 20, and the two elastic section walls 22 can give rise to a special elasticity to enable the elastic section walls 22 compressed inward. Further, the elastic section walls 22 are respectively provided with a barb 221 at the outer end for hooking the outer end of the adhesive tape roller 30. Further, the pivotal shaft 20 is provided with an irregular section wall 23 recessing a little inward, and a one-way constrict wall 24 formed to extend out from the outer surface of the cylindrical body of the pivotal shaft 20 closely along on the irregular wall 23 with a gap (a) formed between the one-way constrict wall 24 and the irregular wall 23 to enable the one-way constrict wall 24 elastically shrink inward. The one-way constrict wall 24 has its end 241 located beyond the inner diameter of the paper tube 31 of an adhesive tape roll 30.

Next, it should be particularly mentioned that as shown in FIG. 3, the sidewall 11 is provided with two slots 111 to correspond to the barbs 221 of the elastic section walls 22, and another slot 112 to correspond to the one-way constrict wall 24 so that the gap (a) may be formed for the barbs 221 to pass through during the molding process, and also for the elastic section walls 22 and the one-way constrict wall 24 to have enough flexibility for shrinking.

Figure 5:
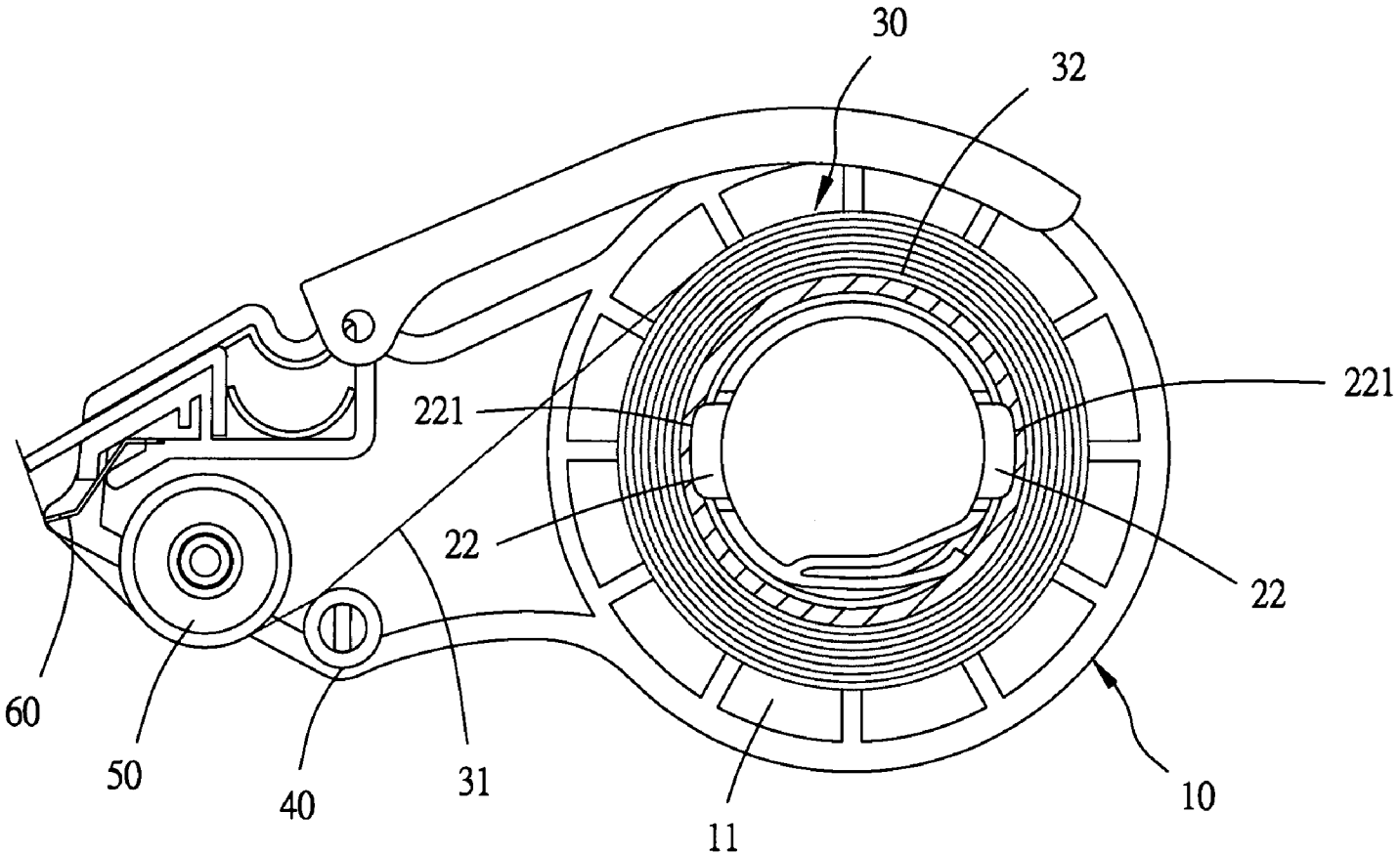

Next, as shown in FIG. 5, this adhesive tape dispenser has a function of easily fitting the adhesive tape roll 30, and in the fitting process, the paper tube 32 of an adhesive tape roll 30 is pushed toward around the free end of the pivotal shaft 20, and during the early stage of the process the inner surface of the paper tube 32 of the adhesive tape roll 30 may touch the two barbs 221 of the two elastic hook members 22 and the one-way constrict wall 24, and compress the two components 22 and 24 inward elastically and properly. Then the adhesive tape roll 30 can move smoothly inward until it is stopped by the sidewall 11, as shown in FIG. 5. Then the adhesive tape roll 30 is automatically secured stably by means of the two barbs 221 of the two elastic section walls 22 of the pivotal shaft 20, as the two barbs 221 can hook and stop the outer end of the paper tube 32. Therefore, the adhesive tape roll 30 is prevented from sliding and falling off the pivotal shaft 20. At the same time, the adhesive tape roll 30 can only rotate only forward in one way by the one-way constrict wall 24 of the pivotal shaft 20 tightly pushing outward the inner surface of the paper tube 32. Accordingly, when the adhesive tape 32 is pulled to extend through the gap between the small roller 40 and the guide roller 50 to reach the blade 60 for being cut off after the adhesive tape 32 is adhered on an object, smoothly extending out without possibility of moving reversely by means of the expanding function of the constrict wall 24 and one-way movement of the pivotal shaft 20 against the paper tube 31 of the adhesive tape roll 3. Thus the drawback of the conventional adhesive tape dispenser is improved.

While the preferred embodiment of the invention has been described above, it will be recognized and understood that various modifications may be made therein and the appended claims are intended to cover all such modifications that may fall within the spirit and scope of the invention.

What is claimed is:

1. An adhesive tape roll fixing device for an adhesive tape dispenser, said tape roll fixing device including a rotational shaft fixed on a rear portion of a sidewall of a dispenser body for a paper tube of an adhesive tape roller to be rotationally fitted thereon, a small roller, a guide roller and a blade provided in order from rear to front at a front portion of said sidewall, the adhesive tape of said adhesive tape roll being pulled to extend through the gap between said small roller and said guide roller forward to reach and be cut by said blade;

Characterized by said rotational shaft being a cylindrical body extending sidewise from said sidewall, said rotational shaft having at least two lengthwise slots spaced apart in its cylindrical body, two elastic section walls defined by said two lengthwise slots and possible to be compressed elastically inward, a hook formed at an outer end of each said elastic section member, a one-way constricting wall provided to extend from the outer surface of the cylindrical body of said rotational shaft closely along an irregular section wall of the cylindrical body with a gap formed between said constricting wall and said irregular wall of the cylindrical body for said constricting wall to flexibly constrict inward, said one-way constrict wall having its outer end located beyond the inner diameter of said paper tube of said adhesive tape roll fitted on said rotational shaft so that the paper tube of said adhesive tape roller may be pushed outward and kept in place by said constricting wall of said rotational shaft after the adhesive tape roll is fitted around said rotational shaft, said adhesive tape roll fitted on said rotational shaft being securely held off, said one-way constricting wall elastically expanding tightly against said paper tube of said adhesive tape roller to let said adhesive tape roll rotate only forward, but not backward; and said one-way constricting wall has a slot.

2. The adhesive tape roller fixing device for an adhesive tape dispenser as claimed in claim 1, wherein each of said elastic section walls respectively has a slot.

3. The adhesive tape roller fixing device for an adhesive tape dispenser as claimed in claim 1, wherein said rotational shaft has two symmetrical elastic section walls.

4. The adhesive tape roller fixing device for an adhesive tape dispenser as claimed in claim 1, wherein said rotational shaft has an irregular section wall facing said one-way constricting wall, and said irregular section wall constricts inward.

* * * * *